US005704611A

United States Patent [19]

Pierce

[11] Patent Number: 5,704,611

[45] Date of Patent: Jan. 6, 1998

[54] WEIGHT LOSS GAME

[75] Inventor: Ruth Bard Pierce, Annandale, N.J.

[73] Assignee: Gamewich LLC, Annandale, N.J.

[21] Appl. No.: 724,767

[22] Filed: Oct. 3, 1996

[51] Int. Cl.[6] ..... A63F 3/00

[52] U.S. Cl. ..... 273/243

[58] Field of Search ..... 273/242, 243, 273/248, 249

[56] References Cited

U.S. PATENT DOCUMENTS

| | | | |
|---|---|---|---|
| 2,314,387 | 3/1943 | Carlsson . | |
| 2,337,594 | 12/1943 | Easley . | |
| 2,380,044 | 7/1945 | Hoffman . | |
| 2,768,452 | 10/1956 | Littlejohn . | |
| 2,918,730 | 12/1959 | Schrade . | |
| 2,965,978 | 12/1960 | Olson . | |
| 3,191,184 | 6/1965 | Durstewitz . | |
| 3,211,458 | 10/1965 | Wells et al. . | |
| 3,491,715 | 1/1970 | Longarini . | |
| 3,656,751 | 4/1972 | Glass et al. . | |
| 3,782,009 | 1/1974 | Darnell . | |
| 3,862,615 | 1/1975 | Liou . | |
| 3,889,953 | 6/1975 | Grasham . | |
| 3,897,064 | 7/1975 | Sonnabend . | |
| 3,941,388 | 3/1976 | Isaac et al. . | |
| 3,994,499 | 11/1976 | Barlow . | |
| 4,003,150 | 1/1977 | Anderson et al. . | |
| 4,003,577 | 1/1977 | Bolach . | |
| 4,040,628 | 8/1977 | Pope . | |
| 4,159,117 | 6/1979 | Kuna . | |
| 4,174,840 | 11/1979 | Curtiss | 273/243 X |
| 4,201,388 | 5/1980 | Cantelon . | |
| 4,344,625 | 8/1982 | Frudakis . | |
| 4,368,889 | 1/1983 | Reker | 273/243 |
| 4,398,721 | 8/1983 | McKay . | |
| 4,440,396 | 4/1984 | Frudakis . | |
| 4,718,675 | 1/1988 | Rosenberg et al. . | |
| 4,900,032 | 2/1990 | Erickson et al. . | |
| 4,902,020 | 2/1990 | Auxier . | |
| 4,940,239 | 7/1990 | Tuttle | 273/243 |
| 4,986,757 | 1/1991 | Mueller . | |
| 5,224,862 | 7/1993 | Sullivan | 273/243 X |
| 5,360,216 | 11/1994 | Counterman | 273/243 |
| 5,451,061 | 9/1995 | DeLessio et al. . | |

*Primary Examiner*—William E. Stoll

*Attorney, Agent, or Firm*—Lerner, David, Littenberg, Krumholz & Mentlik

[57] ABSTRACT

A weight loss game and a method of playing the same is provided. The game provides the players with an entirely optional game strategy choice of proceeding along a healthy lifestyle path or a crash diet path to accomplish the goal of losing a predetermined amount of imaginary weight, primarily through answering questions.

12 Claims, 2 Drawing Sheets

WEIGHT LOSS GAME

FIELD OF THE INVENTION

The present invention relates to weight loss board games. More particularly, the present invention relates to a weight loss board game in which players answer questions in order to succeed.

BACKGROUND OF THE INVENTION

Prior art inventors have expended great effort to develop weight loss and nutritional board games where players move a game piece around contiguous spaces on a game board. Although certain of these games may be fun to play, none of them allow the players to optionally select a game strategy path.

For example, U.S. Pat. Nos. 4,440,396 and 4,344,625 disclose a diet board game having hazard and benefit spaces. The object of the game disclosed in the '396 and the '625 patents is for a player to lose a predetermined amount of weight. The '396 patent is directed toward a method of playing a game while the '625 patent is directed toward the game structure itself. However, the game and method of playing such game disclosed in these patents do not include multiple game strategy paths which can be optionally selected by the players.

U.S. Pat. No. 4,900,032 discloses an inner path and an outer path where the players may choose one of the two paths only if they land on a certain playing space. In particular, the '032 patent discloses that a player can only move into an advantageous path called the "fat farm" if the player lands on a designated playing space called a "weigh station square."

U.S. Pat. No. 4,040,628 is directed toward a board game where each player starts with a predetermined amount of weight. The first player to lose this weight will be the winner of the game. There is no disclosure whatsoever in the '628 patent, or the other patents discussed above, where the players have an entirely optional choice of selecting one of two possible game paths that emulate different game strategies through which the players may gain or lose weight.

The present invention overcomes this shortcoming in the prior art by providing a fun weight loss board game which is more representative of real life decisions than prior art games.

SUMMARY AND OBJECTS OF THE INVENTION

In accordance with a first aspect of the present invention, a method of playing a weight loss game is provided. A preferred method may comprise the steps of selecting a game piece and providing each of the plurality of players with a predetermined amount of imaginary weight which is desirable to lose. The imaginary weight may comprise tokens, each of which represent a certain amount of imaginary weight. The preferred method may also comprise the step of using a chance device to determine the number of spaces that a selected player should move the assigned game piece around an associated weight loss game board in a given turn.

A starting space is provided on the game board. The preferred method includes the step of optionally selecting one of a plurality of possible game paths from a starting space along which a player may move the selected game piece the permitted quantity of spaces revealed by the chance device. In accordance with a particularly preferred method, the step of using a chance device comprises rolling at least one die. However, various other types of chance devices may be used in place of dice. The preferred method may also comprise the step of continuing to use the chance device to determine the number of spaces that the selected game piece can be moved around the selected game path in a given turn. After a player moves the game piece around all playing spaces of a selected game path, the game piece will be returned to the starting space at which time the player can optionally select a different game path or can continue to move the game piece around the same game path. The steps of moving the game piece along selected spaces on the game board is repeated by the players until a certain amount of weight is lost or until a predetermined amount of time has expired. The person who loses all the predetermined amount of imaginary weight first would be the winner. Alternatively, the person who loses the most imaginary weight at a certain time may be the winner.

In accordance with a particularly preferred method, the step of providing each player with a predetermined amount of imaginary weight comprises providing a predetermined quantity of tokens or lard pieces, each of which correspond to a certain amount of weight. The tokens may be made of plastic, wood, cardboard or other suitable material, and may represent one pound, or other selected weight, for each piece.

In accordance with a further preferred method of playing the present weight loss game, the step of optionally selecting between a plurality of possible game paths comprises selecting between a healthy lifestyle game path during which a player may lose the imaginary weight at a relatively conservative pace with little risk, or a crash diet path during which the players may lose weight at a relatively fast pace but may also gain weight.

A further preferred method of playing a weight loss game comprises involuntarily diverting movement of the selected game piece around one or more diversion paths which may be called "oops loops" where unwanted weight may be gained upon placement of the game piece on certain playing spaces.

It is also preferred for the method of playing the present weight loss game to comprise the step of selecting a question and answer card upon placement of the game piece on certain playing spaces around the game board. Each question and answer card contains multiple categories and may include at least one question whereby weight is lost upon providing a correct answer in response to the question. In accordance with this preferred method, a player may be awarded a greater weight loss upon answering a question when traveling along the crash diet path than when traveling along the healthy lifestyle path.

A further aspect of the present invention relates to the structure of a weight loss game which may be played in accordance with the above-recited methods. In a preferred embodiment, the weight loss game of the present invention comprises a game board having a plurality of game paths where each of the game paths include a plurality of contiguous playing spaces. The game board also includes a starting space arranged between at least two of the game paths which facilitates an optional choice of selecting between the at least two game paths. A plurality of game pieces are provided where a single game piece is preferably selected by each player. The present weight loss game may also comprise a chance device for determining how many playing spaces that a player can move a game piece in a given turn. A plurality of game cards associated with selected playing spaces are also provided. The plurality of game cards include questions to be answered by a player after landing on one of the playing spaces so that the player can lose an imaginary amount of weight.

In accordance with a preferred embodiment of the present weight loss game, the plurality of game paths comprises a healthy lifestyle path and a crash diet path wherein the healthy lifestyle path includes means for losing the imaginary weight at a relatively conservative pace, and wherein the crash diet path includes means for losing the imaginary weight at a relatively fast pace but also includes a risk of gaining additional imaginary weight.

In a further preferred embodiment, the weight loss game may comprise at least one diversion path having a plurality of contiguous playing spaces including means for gaining additional imaginary weight. It is also preferable for the chance device of the present invention to comprise at least one die.

Accordingly, it is an object of the present invention to provide a method of playing a weight loss game where the players have an entirely optional choice of selecting one of at least two game paths through which they can move their respective game pieces in order to lose an imaginary amount of weight.

These and other objects and features of the present invention will be more readily understood when read in conjunction with the detailed description of the preferred embodiments and the drawings which follow.

DETAILED DESCRIPTION OF THE PREFERRED EMBODIMENTS

Figure 1:
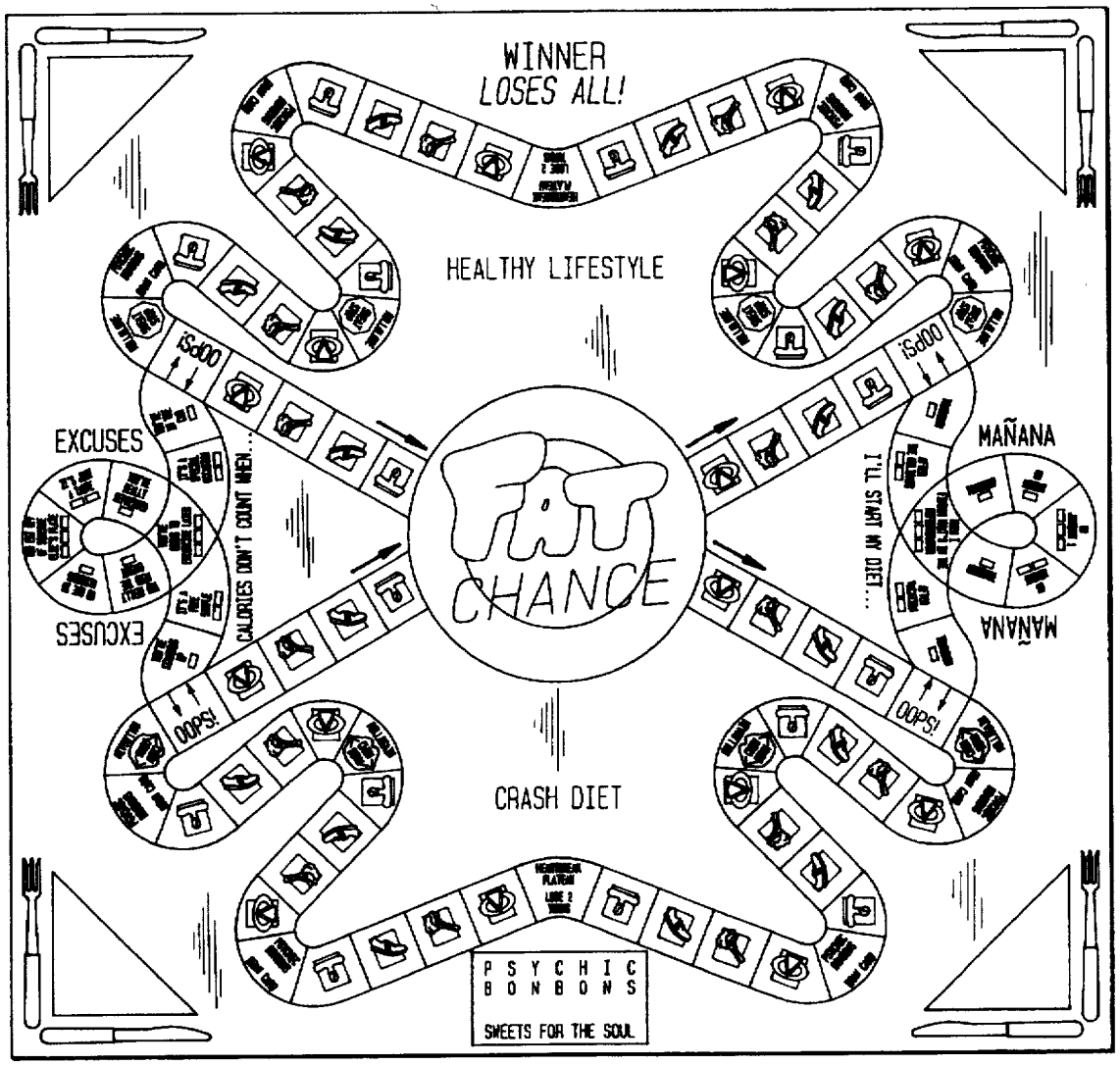
FIG. 1 illustrates a game board in accordance with a preferred embodiment of the present invention.

The weight loss game of the present invention may be marketed in connection with the trademark FAT CHANCE. As in life, the FAT CHANCE game includes a consideration of all of various elements often associated with successful weight loss—calories, nutrition, exercise and attitude. By combining unique steps in the method of playing the present weight loss game and the structure of the game itself, players may enjoy the challenges and frustration of diet plateaus, procrastination and justification, exercise and pig-outs, as well as the emotional rewards of being in control and the ultimate exhilaration of dieting success.

As used herein, the term "imaginary weight" is weight which is not physically gained or lost by the players, but which is representative of weight associated with symbolic elements such as tokens of "lard" which may be made of plastic, wood, cardboard, and the like. It should be appreciated that the concept of imaginary weight may also be used without any physical token or other playing piece. A "lard" token is simply a plastic token or the like which is symbolic of a predetermined amount of imaginary weight, such as one pound. For example, twenty lard tokens may represent twenty pounds of unwanted weight.

The present game may be played with two or more players who engage in one simple object—to lose weight. In a preferred embodiment, each player may start with twenty unwanted pounds, which may be represented by plastic lard tokens. As the players move game pieces around the game board, the players lose weight by correctly answering questions about diet, health, fitness and trivia while trying to avoid the classic diet pitfalls which appear on the board. In accordance with a preferred method, whichever player loses all twenty unwanted pounds first would be considered the winner. Many variations in the ending of the present game exist. For example, instead of playing until one player loses all of the unwanted weight, the players may agree on a time limit. When the time limit is up, the player who has lost the most weight would be considered the winner. In another embodiment, the players may select a winner upon losing less than all of the unwanted weight. For example, each player could start with twenty unwanted pounds, and play the game until a player is successful at losing ten pounds.

In a preferred embodiment, the present game may include one playing board game 10, two dice 12, one special numbered cube 14, 125 plastic tokens 16 (i.e., 125 pounds of lard), several hundred question and answer cards 18, a selected number of PSYCHIC BONBONS cards 20, a score record 22, and a selected number of player game pieces 24.

As preparation to play the game, the PSYCHIC BONBONS cards 20 should be placed on the appropriate PSYCHIC BONBONS space 26 outlined on the surface of the game board 10. Each player should be provided with a certain amount of imaginary weight tokens, such as twenty plastic tokens 16 which represent twenty lard pounds. The players may then select their game pieces 24 and should place the game pieces 24 on the starting space 28 which is represented by a large center circle labeled with the FAT CHANCE trademark.

Players may choose to roll the dice 12 to see who goes first. The player rolling the highest number on the dice 12 will begin the game.

When the first player rolls the dice, he may move his game piece from the starting space 28 at the center of the game board 10 based on a corresponding number of spaces identified by the dice. It should be appreciated that chance devices, other than dice, may be used to play the present game. For example, a spin wheel, numbered cubes or other chance device may be provided.

Before moving the game piece, the player must make an important decision in accordance with a novel aspect of the present invention. In particular, the player must decide which game path will be pursued. As shown in FIG. 1, the board game 10 includes a healthy lifestyle game path 30 and a crash diet game path 32. Although the direction of travel around the respective game paths may vary in alternate embodiments of the present invention, in a preferred embodiment, the player should follow the direction identified by arrows which exit from the starting space 28 at the center of the game board 10. Thus, in the preferred embodiment shown in FIG. 1, the players who select the healthy lifestyle game path 30 would proceed counterclockwise while the players who choose the crash diet game path 32 would proceed clockwise. As the remaining players take their first turn, each player has the option of selecting between the healthy lifestyle game path 30 and the crash diet game path 32.

Once a game path is selected, the player must move his game piece 24 completely around the selected game path and return past the starting space 28. Every time a player passes the starting space 28, he has the option of continuing with the selected diet strategy (i.e., either the healthy lifestyle game path or the crash diet game path) or switching over to the other diet approach. Both of the game paths 30 and 32 include four types of design and color coded question spaces 26, discussed in more detail below, which require the players to select corresponding to question and answer cards, also discussed further below.

The healthy lifestyle game path represents a balanced, moderate, long-term weight management approach which most experts recommend in real life. As the players answer questions on question and answer cards 18 selected along this path, they lose one pound for each correct response. Of course, the amount of weight lost for each correct response may vary in alternate embodiments of the present game. No weight is gained for incorrect answers on the healthy lifestyle game path 30.

Figure 2:
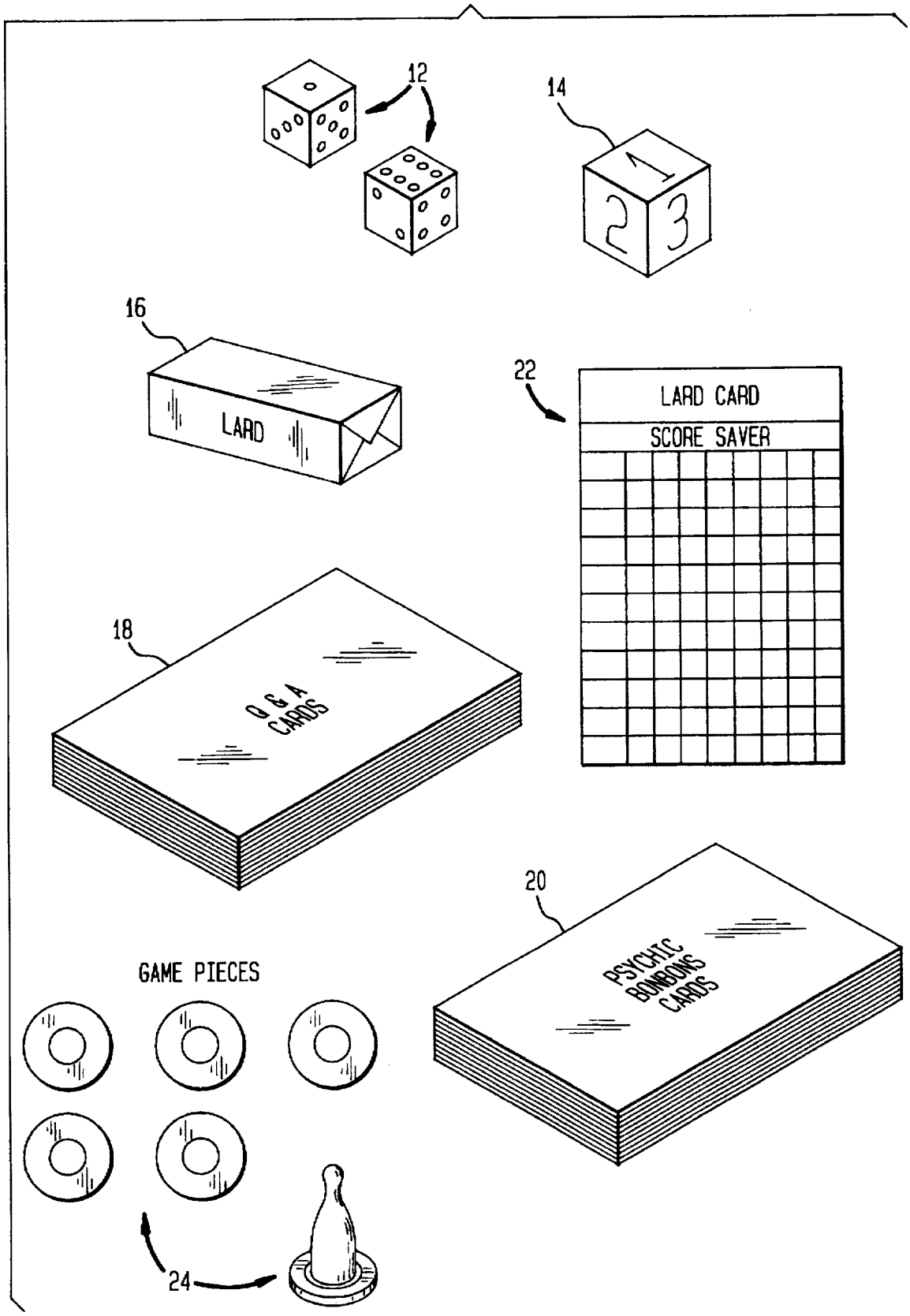
FIG. 2 illustrates accessories for use with the game board shown in FIG. 1 in accordance with a preferred embodiment of the present invention.

In a preferred embodiment, the healthy lifestyle game path includes SWEAT STOP playing spaces which represent exercise routines. When a player lands on a SWEAT STOP space 34, he has an opportunity to roll the specially numbered cube 14 in order to a lose number of pounds which appear on the top face of the cube (i.e., 1, 2 or 3 pounds). As shown in FIG. 2, each side of the six-sided cube includes indicia representing a different amount of weight.

Unlike the healthy lifestyle game path 30, the crash diet game path 32 represents the high-risk, high-reward, less sustainable, quick weight-loss approach which lures many dieters. As the players answer questions along this route, they lose two pounds for each correct response to a question. As indicated above, the total quantity of weight lost for each correct response may vary. However, the quantity of weight lost for each answer along the crash diet path 32 will be greater than the total quantity of weight lost for each correct answer along the healthy lifestyle game path 30. A substantial risk associated with the crash diet path 32 is that, unlike the healthy lifestyle approach, the players will gain weight for each incorrect answer given. There are no SWEAT STOP spaces 34 along the crash diet game path 32 which permit players to roll the specially numbered cube 14 to lose weight. Instead, a further risk that the players on the crash diet game path 32 must contend with is the detrimental CHOW DOWN spaces 36 which represent fattening binges. When a player lands on a CHOW DOWN space, he then rolls the specially numbered cube 14 and gains weight based on the number of pounds displayed.

The PSYCHIC BONBONS spaces 38 represent the wonderful emotional satisfaction reward of pursuing and ultimately achieving a diet or fitness goal. When a player lands on a PSYCHIC BONBONS space 38 he is permitted to select a PSYCHIC BONBONS card 20 which describe a situation and assigns a weight loss amount (i.e., either one, two or three pounds according to self-explanatory situations identified on the PSYCHIC BONBONS card 20. In an optional embodiment of the present invention, certain of the PSYCHIC BONBONS cards may include an "Exercise Your Options" instruction which permit players to actually do physical exercise to lose extra pounds. This version of the present game should not be played by players who are not physically fit to do exercise.

The HEARTBREAK PLATEAU spaces 40 shown in FIG. 1 represent the agonizing periods that all dieters experience when, despite all efforts, weight cannot be lost. When a player lands on a HEARTBREAK PLATEAU space 40, he must skip the next two turns. The only way to avoid this frustrating delay is with a "Plateau Buster" card from the PSYCHIC BONBONS deck. If a player has a Plateau Buster card when he lands on the HEARTBREAK PLATEAU space 40, the card may be turned in with the player continuing to play at the following turn.

In the preferred embodiment shown in FIGS. 1 and 2, the question and answer cards 18 include the following four design and color-coded categories which correspond to question spaces 26: the pie a la mode design (blue on yellow) represents the "Calories Count" category, the broccoli design (green on red) represents the "Nutrition Matters" category, the sneaker design (red on green) represents the "Exercise and the Body" category and the fanciful "T?" design (yellow on blue) represents the "Largely Trivia" category. It should be understood that the designs and colors on the question and answer cards and the associated playing spaces represent an example of a preferred embodiment of the FAT CHANCE game and therefore may be varied in alternate embodiments of the present invention.

When a player lands on any of the aforementioned question spaces 26 which are arranged throughout the healthy lifestyle and crash diet game paths 30 and 32, the next player is required to pick a question and answer card 18 and ask the question which corresponds to the category of the space on which the player has landed. The correct answer appears on the back of the question and answer card. As discussed above, when players answer a question correctly, they are rewarded by losing one pound on the healthy lifestyle game path and two pounds on the crash diet game path. If the question is not answered correctly, no weight is lost or gained on the healthy lifestyle path 30 while weight is gained on the crash diet path 32.

With the exception of the "Calories Count" category which compares two foods, all questions are multiple choice with three possible answers. After each question is read and answered, the question and answer card 18 may be placed in the back of the question and answer card box and the turn then passes to the next player who will roll the dice 12 and move his game piece 24. The "Largely Trivia" category is a two-part, bonus opportunity. If a player answers the first "Largely Trivia" question correctly, he loses a certain amount of imaginary weight dependent upon the chosen game path (i.e., one pound for the healthy lifestyle route and two pounds for the crash diet route). The player then has the option of ending his turn or answering the follow-up "Largely Trivia" question. If the player answers the follow-up "Largely Trivia" question correctly, he will lose one additional pound regardless of the game path selected. However, if the player misses the second question, he ends up losing nothing for the entire turn, thus gaining back the weight loss from answering the first question correctly.

As also shown in FIG. 1, the present game board includes forced diversion paths identified as Mañana-Mañana and Excuses-Excuses paths 44 and 42 (i.e., OOPS LOOPS paths). These diversion paths are also shown in FIG. 1 in conjunction with the phrases "I'LL START MY DIET . . ." and "CALORIES DON'T COUNT WHEN . . . ." These diversion paths 42 and 44 should be avoided if at all possible. They represent the fattening procrastinations and justifications that all dieters fall prey to from time to time. When a player lands on an OOPS space 46, he is required to enter and move completely around the associated OOPS LOOP path 42 or 44. Once diverted into the OOPS LOOP path 42 or 44, the players continue to roll the dice during each turn, but pack on dreaded extra pounds in accordance with the weight identified on the spaces within the OOPS LOOP 42 or 44. Players must move in only one direction and must complete the full loop cycle while in an OOPS LOOP path 42 or 44. Thus, players are diverted off of their originally selected game path when they exit the OOPS LOOP path 42 or 44 and must travel once around the other path (either the healthy lifestyle path 30 or the crash diet path 32).

Although variations on the ending of the present game may be used, a preferred method is that the game ends when the first player loses all of the imaginary extra pounds assigned. Thus, the first big loser becomes the ultimate big winner.

It should be appreciated that various modifications can be made in the steps of playing the present game and in the structure of the game itself while remaining within the spirit and scope of the present invention which is defined by the claims set forth below.

I claim:

1. A method of playing a weight loss game comprising the steps of: selecting a game piece; providing each of a plurality of players with a predetermined amount of imaginary weight which is desirable to lose; using a chance device to determine the number of spaces that a selected player can move said selected game piece around contiguous spaces of an associated weight loss game board in a given turn; optionally selecting from a starting space one of a plurality of possible game paths along which a player can move said game piece, and moving said game piece from said starting space along the selected game path in accordance with the permitted quantity of spaces revealed by said chance device; continuing to use said chance device to determine the number of spaces that said game piece can be moved around said selected game path in a given turn, until returning to said starting space where the player can optionally select a different game path or can continue to move said game piece around the same game path; repeating the steps of moving said game piece along spaces on said game board until either a desired amount of weight is lost or until a predetermined amount of time has expired.

2. The method of claim 1 wherein said step of providing each of said players with a predetermined amount of weight comprises providing a predetermined quantity of tokens, each of said tokens corresponding to a certain amount of imaginary weight.

3. The method of claim 2 wherein each token represents one pound of unwanted weight.

4. The method of claim 1 wherein said step of using a chance device comprises rolling at least one die.

5. The method of claim 1 wherein said step of optionally selecting between a plurality of game paths comprises selecting between a healthy lifestyle path during which said imaginary weight may be lost at a relatively conservative pace and a crash diet path during which said imaginary weight may be increased or decreased at a relatively fast pace.

6. The method of claim 1 further comprising the step of diverting movement of said assigned game piece around a diversion path where unwanted weight may be gained upon placement of said game piece on a certain space on said game board.

7. The method of claim 1 wherein a player may win said weight loss game upon losing all of said predetermined imaginary weight provided at the beginning of the game.

8. The method of claim 1 further comprising the step of selecting a question and answer card upon landing of said game piece on a certain game space on said game board and answering a question within a category on said question and answer card which corresponds to the category of said certain game space.

9. The method of claim 8 further comprising the step of answering at least one question on said selected question and answer card whereby said imaginary weight is lost upon providing a correct answer in response to said question.

10. The method of claim 9 wherein said step of optionally selecting between a plurality of game paths comprises selecting between a healthy lifestyle path during which said imaginary weight may be lost at a relatively conservative pace and a crash diet path during which said imaginary weight may be increased or decreased at a relatively fast pace.

11. The method of claim 10 wherein a player is awarded a greater weight loss upon correctly answering a question when traveling along said crash diet path than when traveling along said healthy lifestyle path.

12. The method of claim 1 further comprising the step of performing physical exercise in response to instructions on a certain game card obtained by landing on certain playing spaces in order to lose said imaginary weight.

* * * * *